US006051103A

United States Patent [19]

Aikawa

[11] Patent Number: 6,051,103

[45] Date of Patent: Apr. 18, 2000

[54] PAPER-MAKING SCREEN APPARATUS

[75] Inventor: Yoshihiko Aikawa, Shizuoka, Japan

[73] Assignee: Aikawa Iron Works Co., Ltd., Shizuoka, Japan

[21] Appl. No.: 09/071,894

[22] Filed: May 5, 1998

[30] Foreign Application Priority Data

Dec. 25, 1997 [JP] Japan ..... 9-356756
Mar. 12, 1998 [JP] Japan ..... 10-061704

[51] Int. Cl.[7] ..... D21C 9/08; D21C 7/00

[52] U.S. Cl. ..... 162/55; 162/251; 162/380; 209/233; 209/235; 209/395; 209/411

[58] Field of Search ..... 162/55, 380, 251; 209/233, 235, 395, 411

[56] References Cited

U.S. PATENT DOCUMENTS 5,061,370 10/1991 Ferland et al. ..... 162/380
5,071,543 12/1991 Rajala ..... 162/380
5,221,437 6/1993 Sieron et al. ..... 162/380
5,605,234 2/1997 Aikawa ..... 209/395
5,647,128 7/1997 Aikawa ..... 209/395
5,791,495 8/1998 Gero et al. ..... 209/395
5,798,025 8/1998 Iwashige ..... 162/380
5,799,798 9/1998 Chen ..... 162/251
5,804,075 9/1998 Aikawa ..... 209/395

*Primary Examiner*—Christopher A. Fiorilla
*Attorney, Agent, or Firm*—Kanesaka & Takeuchi

[57] ABSTRACT

A paper-making screen apparatus for separating foreign matters from paper-making raw materials is formed of a screen having a first annular end plate located at an end; a second annular end plate located at the other end thereof, having a plurality of openings for male screws; a plurality of interval keeping members secured to the first and second end plates to keep an interval therebetween, and having female screws on the side facing the second end plate; a plurality of male screws engaging the female screws; and a plurality of rod-shaped members connected to the first and second end plates, and annularly arranged parallel to each other at certain intervals. The first and second end plates hold ends of the plurality of rod-shaped members in between, and the second end plate is secured to the interval keeping members by engaging the male screws via the openings for male screws provided in the second end plate with the female screws and tightening the second end plate against the plurality of interval keeping members.

6 Claims, 14 Drawing Sheets

PAPER-MAKING SCREEN APPARATUS

BACKGROUND OF THE INVENTION

1. Field of the Invention

The present invention relates to a paper-making screen apparatus. More particularly, the present invention relates to a paper-making screen apparatus having an improved screen, in which the interval between a first end plate and a second end plate is kept by interval keeping members, and further, ends of rod-shaped members are held by a first and second end plates.

2. Description of the Related Art

There is available paper-making screen apparatus in which a screen is formed by annularly arranging a plurality of rod-shaped members between a first annular support member (first end plate) located on one end side and a second support member (second end plate) located on the other end side (for example, U.S. Pat. No. 5,605,234 and U.S. patent application Ser. No. 08/741,718).

In U.S. patent application Ser. No. 08/741,718, an interval keeping member is provided between a first annular supporting member and a second annular supporting member to keep an interval between the supporting members, and further, ends of a plurality of rod-shaped members annularly provided are held by and between the first supporting member and the second supporting member. An end of the interval keeping member is secured by welding to the first supporting member, and the other end of the interval keeping member, to the second supporting member, respectively (see FIG. 6 of U.S. patent application Ser. No. 08/741,718).

In a screen disclosed in U.S. Pat. No. 5,605,234, ends of rod-shaped members are individually secured by welding (see FIGS. 6 and 9 of U.S. patent application Ser. No. 08/741,718; while screws are used in FIG. 9, ends of the rod-shaped members are secured by welding to the first supporting member and the second supporting member, respectively).

Particularly when securing by welding, welding is carried out while applying a force by a press to ensure a state of firm fixture. This leads to a low operability, making it difficult to manufacture the same, and in addition, welding strain causes a deformation, and hence deterioration of screen performance, not permitting achievement of uniform intervals between adjacent rod-shaped members. When replacing damaged rod-shaped members after assembly, furthermore, it is necessary to grind off welded portions with a grinder, this posing a problem of a very poor operability.

The present invention has an object to provide a paper-making screen apparatus for solving the problems as described above.

SUMMARY OF THE INVENTION

To achieve the foregoing object, the paper-making screen apparatus of the invention comprises a screen for separating foreign matter from paper-making raw materials via, the screen having a first annular end plate located at an end thereof; a second annular end plate located at the other end thereof, having a plurality of openings for male screws; a plurality of interval keeping members each secured to the first end plate and the second end plate, keeping an interval from the first end plate and the second end plate, and having female screws on the side facing the second end plate; a plurality of male screw engaging the female screws; and a plurality of rod-shaped members each having an end in contact with the first end plate and the other end in contact with the second end plate, and annularly arranged in parallel with each other at certain intervals. The first end plate and the second end plate hold the ends of the plurality of rod-shaped members in between, and the second end plate is secured to the interval keeping members by engaging the male screw via the openings for the male screws provided in the second end plate with the female screws and tightening the second end plate against the plurality of intervals keeping members.

In the paper-making screen apparatus of the invention, the screen may be formed of a first annular end plate located at an end thereof; a second annular end plate, located at the other end thereof, having a plurality of openings for male screws; an annular intermediate support member, provided between the second end plate and the first end plate, and having openings for the plurality of interval keeping members and engaging sections for the plurality of rod-shaped members provided annularly; the plurality of interval keeping members passing through the openings for the interval keeping members of the intermediate support member, secured to the first end plate and the second end plate, thereby keeping an interval between the first end plate and the second end plate, and each having a female screw on the side thereof facing the second end plate; a plurality of male screws engaging with the female screws; and a first span holding member group, located on the outer periphery of each of the interval keeping members, provided between the first end plate and the intermediate support member, and each being in contact with the first end plate and the intermediate support member facing thereto, thereby keeping an interval between the first end plate and the intermediate support member facing thereto; a second span holding member group, located on the outer periphery of each of the interval keeping members, provided between the second end plate and the intermediate support member, and each being in contact with the second end plate and the intermediate support member facing thereto, thereby keeping an interval between the second end plate and the intermediate support member facing thereto; and a plurality of rod-shaped members each having an end in contact with the first end plate and the other end in contact with the second end plate, passing through the engaging section for rod-shaped members, and annularly arranged in parallel with each other at certain intervals; the first end plate and the second end plate holding the ends of the plurality of rod-shaped members in between; the rod-shaped members engaging with the engaging sections for rod-shaped members being free from regulation in the longitudinal direction of the rod-shaped members, and regulated for movement in a direction at right angles to the longitudinal direction of the rod-shaped members; and the second end plate being secured to the interval keeping members by engaging the male screws via the openings for the male screws provided in the second end plate with the female screws and tightening the second end plate against the plurality of interval keeping members.

Further, in the paper-making screen apparatus of the invention, the screen may be formed of a first annular end plate located at an end thereof; a second annular end plate located at the other end thereof, having a plurality of openings for male screws; at least two annular intermediate support members, provided between the second end plate and the first end plate, and having openings for the plurality of interval keeping members and engaging sections for the plurality of rod-shaped members provided annularly; a plurality of interval keeping members passing through the openings for the interval keeping members of the intermediate support member, secured to the first end plate and the second end plate, thereby keeping an interval between the first end plate and the second end plate, and each having a female screw on the side thereof facing the second end plate; a plurality of male screws engaging with the female screws; at least one middle span holding member group, located on the outer periphery of each of the plurality of interval keeping members, provided between two opposed intermediate support members, and keeping the interval between the opposed intermediate support members by coming into contact with the opposed intermediate support members; a first span holding member group, located on the outer periphery of each of the interval keeping members, provided between the first end plate and the intermediate support member closest to the first end plate, and coming into contact with the opposed first end plate and the intermediate support member closest to the first end plate, thereby holding the interval between the opposed first end plate and the intermediate support member closest to the first end plate; a second span holding member group, located on the outer periphery of each of the interval keeping members, provided between the second end plate and the intermediate support member closest to the second end plate, and coming into contact with the opposed second end plate and the intermediate support member closest to the second end plate, thereby holding the interval between the opposed second end plate and the intermediate support member closest to the second end plate; and a plurality of rod-shaped members each having an end in contact with the first end plate and the other end in contact with the second end plate, passing through the engaging sections for rod-shaped members, and annularly arranged in parallel with each other at certain intervals; the first end plate and the second end plate holding the ends of the plurality of rod-shaped members in between; the rod-shaped members engaging the engaging sections for rod-shaped members being free from regulation in the longitudinal direction of the rod-shaped members, and regulated for movement in a direction at right angles to the longitudinal direction of the rod-shaped members; and the second end plate being secured to the interval keeping members by engaging the male screws via the openings for the male screws provided in the second end plate with the female screws and tightening the second end plate against the plurality of interval keeping members.

Further, in the paper-making screen apparatus of the invention, the screen may be formed of a first annular end plate located at an end thereof; a second annular end plate located at the other end thereof, having a plurality of openings for male screws; an intermediate support member for connection, provided between the second end plate and the first end plate, and having openings for interval keeping members; a plurality of interval keeping members, passing through the openings for interval keeping members, secured to the first end plate and the second end plate, keeping an interval between the first end plate and the second end plate, and each having female screws on the side thereof facing the second end plate; a plurality of male screws engaging with the female screws; a plurality of first rod-shaped members annularly arranged in parallel with each other at certain intervals between the first end plate and the intermediate support member for connection; and a plurality of second rod-shaped members annularly arranged in parallel with each other at certain intervals between the second end plate and the intermediate support member for connection; ends of the plurality of rod-shaped members being held between the first end plate and the intermediate support member for connection, and ends of the plurality of second rod-shaped members being held between the second end plate and the intermediate support member for connection; and the second end plate being secured to the interval keeping members by engaging the male screws via the openings for the male screws provided in the second end plate with the female screws and tightening the second end plate against the plurality of interval keeping members.

In the paper-making screen apparatus, the first end plate may comprise a first end plate ring and a first end plate contact member; the first end plate contact member is located on the side closer to the second end plate than the first end plate ring, is in contact with the first end plate ring, and has a plurality of openings for interval keeping members and a plurality of engaging sections for rod-shaped members provided annularly; the second end plate comprises a second end plate ring and a second end plate contact member; the second end plate contact member is located on the side closer to the first end plate than the second end plate ring, is in contact with the second end plate ring, and has a plurality of openings for interval keeping members and a plurality of engaging sections for rod-shaped members provided annularly; and the plurality of openings for interval keeping members and the plurality of engaging sections for rod-shaped members provided annularly of the first end plate contact member and the second end plate contact member are formed by cutting with a press, a laser beam or a wire cutter.

In the paper-making screen apparatus, the first end plate may comprise a first end plate ring and a first end plate contact member; the first end plate contact member is located on the side closer to the second end plate than the first end plate ring, is in contact with the first end plate ring, and has a plurality of openings for interval keeping members and a plurality of engaging sections for rod-shaped members provided annularly; the second end plate comprises a second end plate ring and a second end plate contact member; the second end plate contact member is located on the side closer to the first end plate than the second end plate ring, is in contact with the second end plate ring, and has a plurality of openings for interval keeping members and a plurality of engaging sections for rod-shaped members provided annularly; and the intermediate support member, the plurality of openings for interval keeping members and the plurality of engaging sections for rod-shaped members provided annularly of the first end plate contact member and the second end plate contact member are formed by cutting with a press, a laser beam or a wire cutter, and the first end plate contact member, the second end plate contact member and the intermediate support member are the same parts.

DESCRIPTION OF THE PREFERRED EMBODIMENTS

Now, a paper-making screen apparatus of an embodiment of the invention will be described below with reference to the drawings. In FIGS. 1 to 9, 1 is a paper-making screen apparatus. The paper-making screen apparatus 1 is to separate foreign matters from paper-making raw materials via a screen S.

Figure 1:
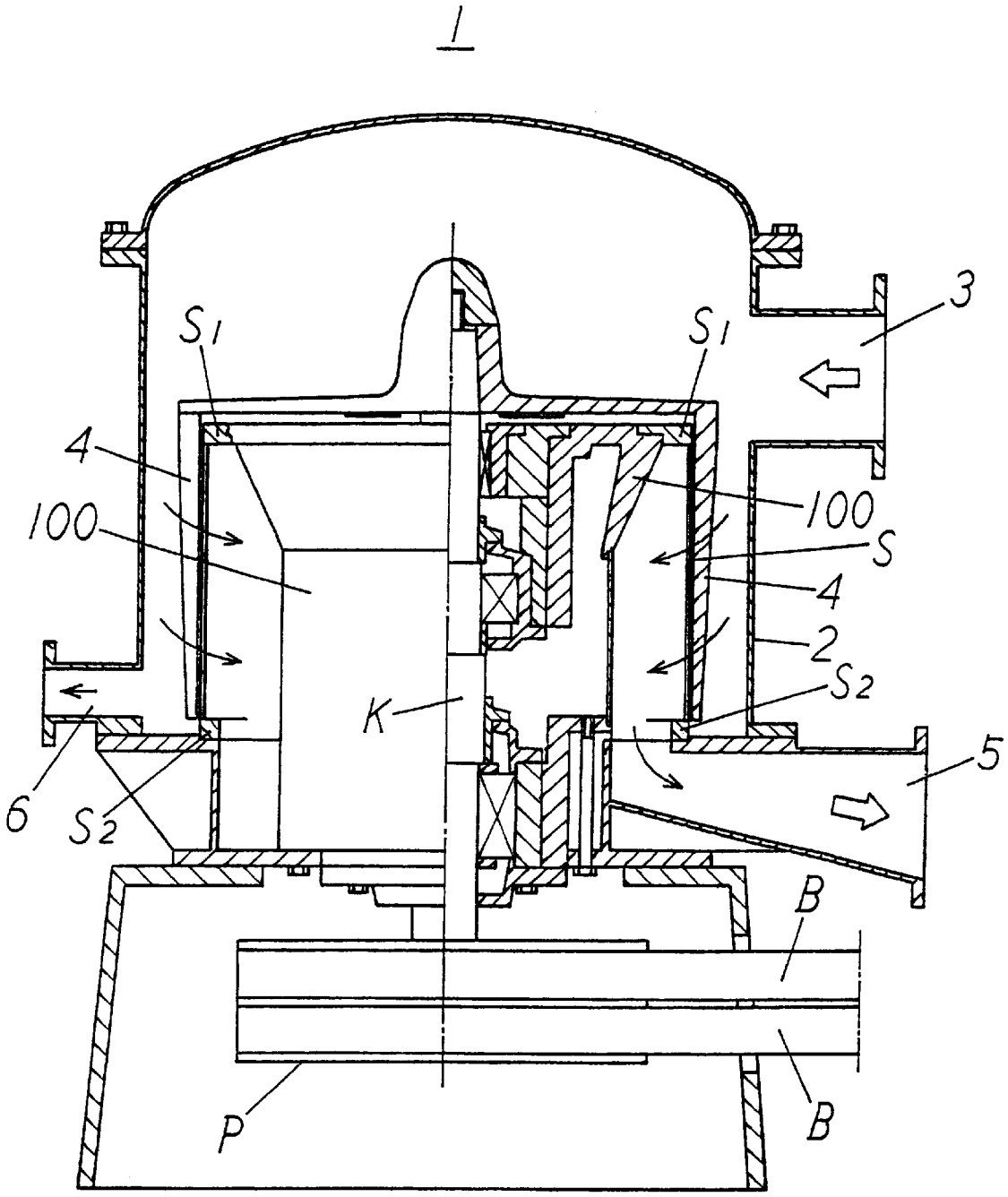
FIG. 1 is a schematic sectional view illustrating a paper-making screen apparatus of an embodiment of the invention.

As shown in FIG. 1, paper-making raw materials enter into the apparatus through a paper-making raw material entry 3 provided in a casing 2, and stirred by a stirring member 4. Foreign matters contained in the paper-making raw materials cannot pass through the screen S; acceptable raw materials pass through meshes of the screen S and are discharged to outside the casing 2 through a paper-making raw material exit 5 provided in the casing 2. Foreign matters that cannot pass through the meshes of the screen S are discharged to outside the casing 2 from a foreign matter exit 6 provided in the casing 2. The stirring member 4 is rotated by a driving force from a motor not shown transmitted through a belt B, a pulley P and a rotating shaft K.

Figure 2:
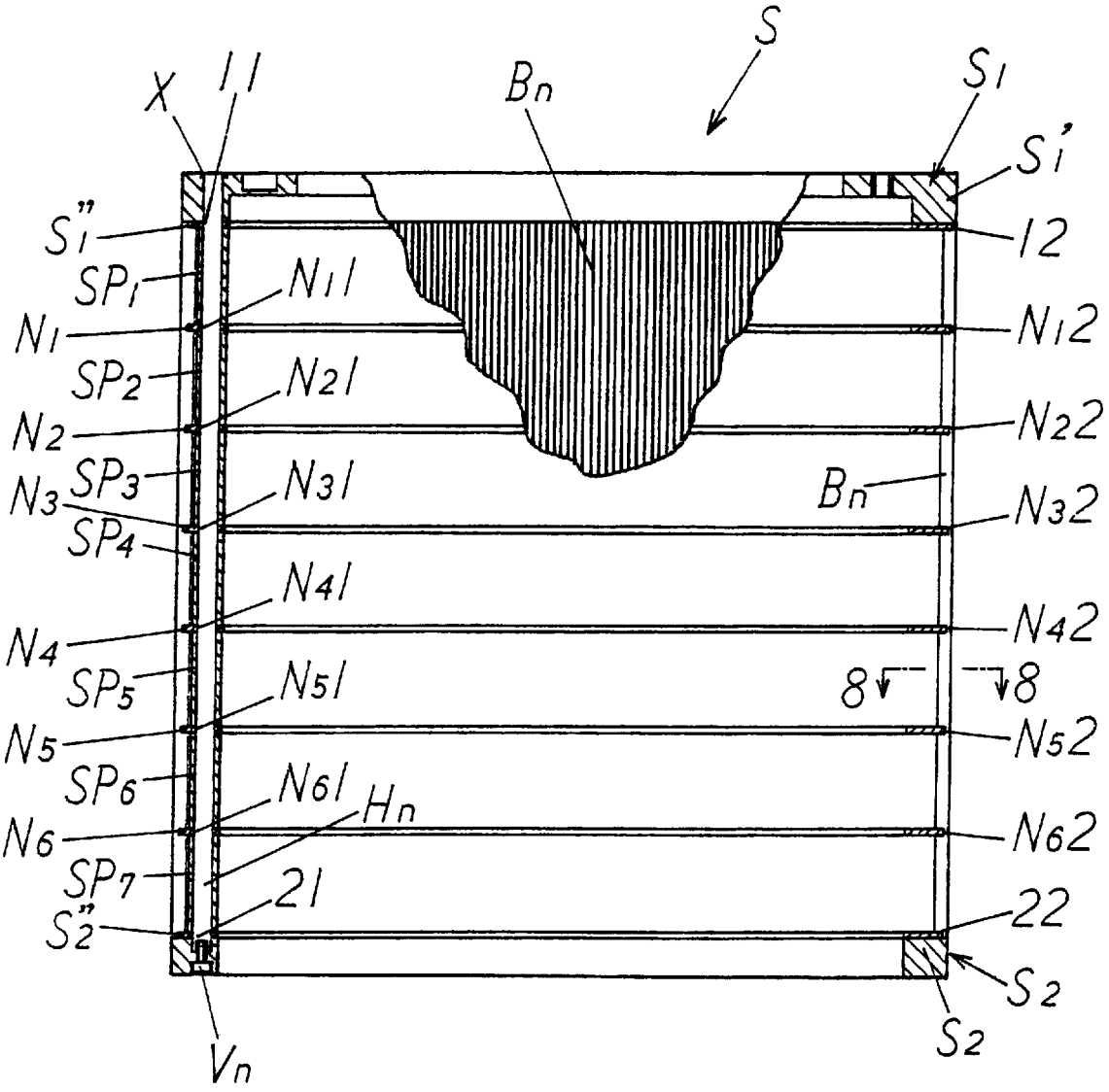
FIG. 2 is a partially cutaway schematic sectional view illustrating the screen shown in FIG. 1.

The screen S has a first annular end plate $S_1$ located on one end side thereof, and a second annular end plate $S_2$ located on the other side thereof so that the first end plate $S_1$ and the second end plate $S_2$ face each other as shown in FIG. 2.

A plurality of openings $K_n$ for male screws is annularly provided in the second end plate $S_2$ (the present embodiment has eight openings $K_n$ for male screws). The first annular end plate $S_1$ and the second annular end plate $S_2$ are more specifically, for example, rings.

$H_n$ shown in FIGS. 2, 3, 6 and 9 are interval keeping members. The interval keeping members $H_n$ (this embodiment has eight interval keeping members) are secured between the first end plate $S_1$ and the second end plate $S_2$ so as to keep an interval between the first end plate $S_1$ and the second end plate $S_2$. Female screws $M_n$ (this embodiment has eight female screws $M_n$) are provided on the side of the interval keeping members $H_n$ facing the second end plate $S_2$. $V_n$ are male screws engaging with the female screws $M_n$, and there are a plurality of male screws $V_n$, eight in this embodiment.

Figure 4:
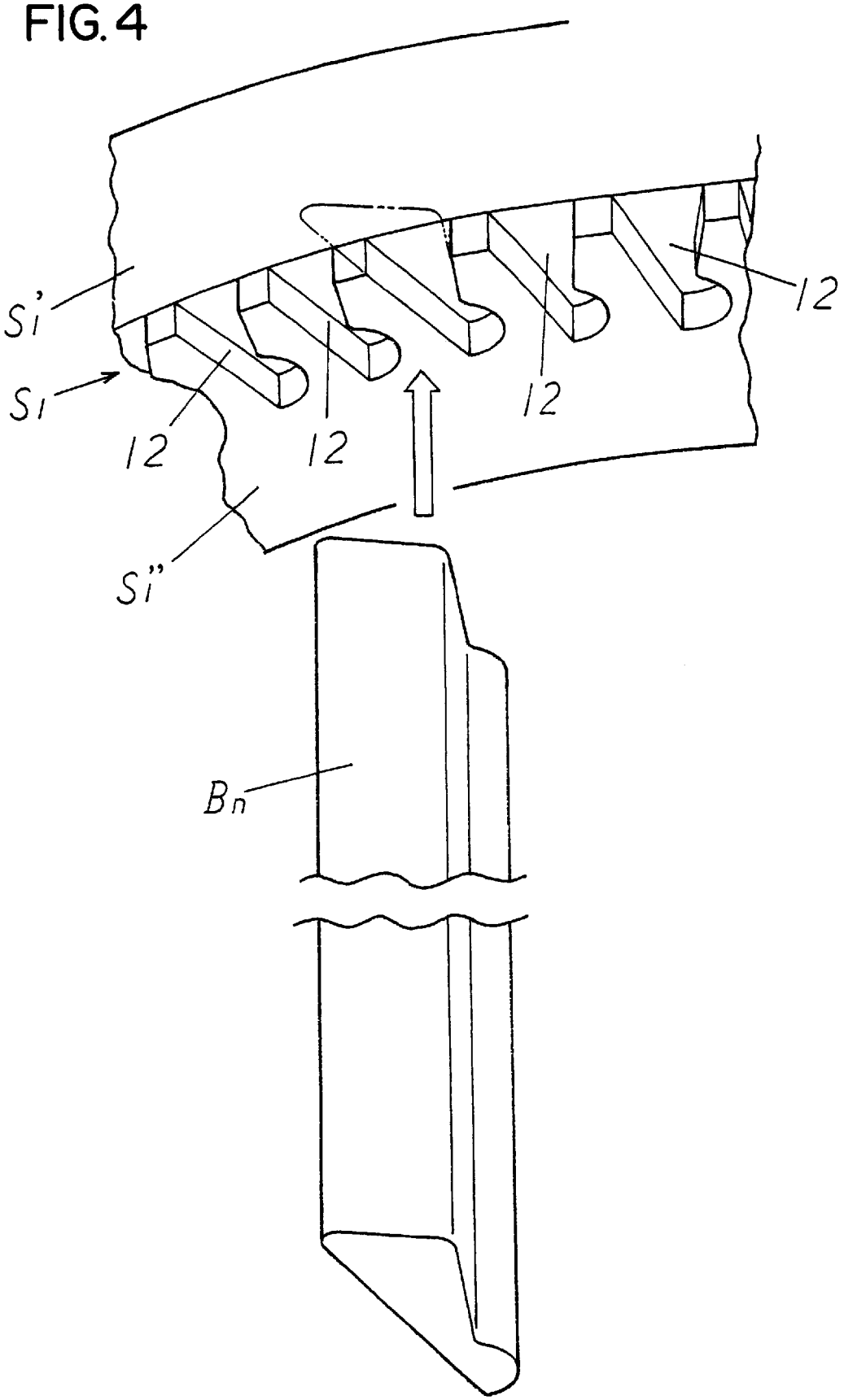
FIG. 4 is a schematic perspective view for illustrating the state of engagement of a rod-shaped member and an engaging section for rod-shaped member of a first end plate contact member shown in FIG. 2.
Figure 5:
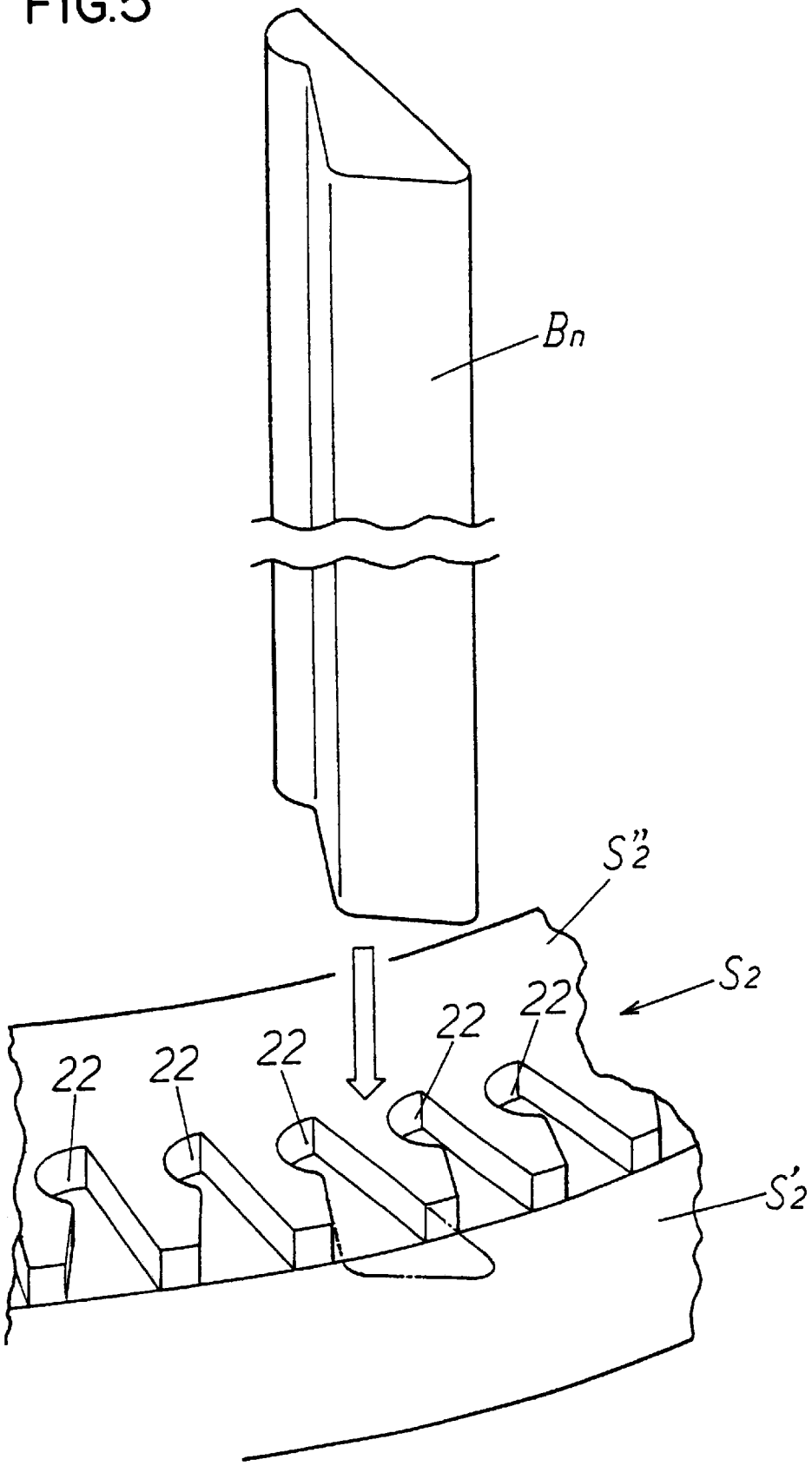
FIG. 5 is a schematic perspective view for illustrating the state of engagement of a rod-shaped member and an engaging section for rod-shaped member of a second end plate contact member shown in FIG. 2.

$B_n$ shown in FIGS. 4 and 5 are rod-shaped members. An end of a rod-shaped member $B_n$ comes into contact with the first end plate $S_1$, and the other end thereof, with the second end plate S2, respectively. A plurality of rod-shaped members $B_n$ (in this embodiment, for example, about 500) annularly provided at intervals. An interval is formed between two adjacent rod-shaped members $B_n$. The rod-shaped members $B_n$ are located outside the interval keeping members $H_n$. The rod-shaped members $B_n$ are formed, for example, by drawing, and have substantially a uniform sectional shape.

The ends of the plurality of rod-shaped members $B_n$ are held between the first end plate $S_1$ and the second end plate $S_2$ held by the plurality of interval keeping members $H_n$, and an interval T of the screen S is formed by adjacent rod-shaped members $B_n$. In other words, the rod-shaped members $B_n$ are adjacent to each other and annularly arranged so as to keep an interval T.

Figure 3:
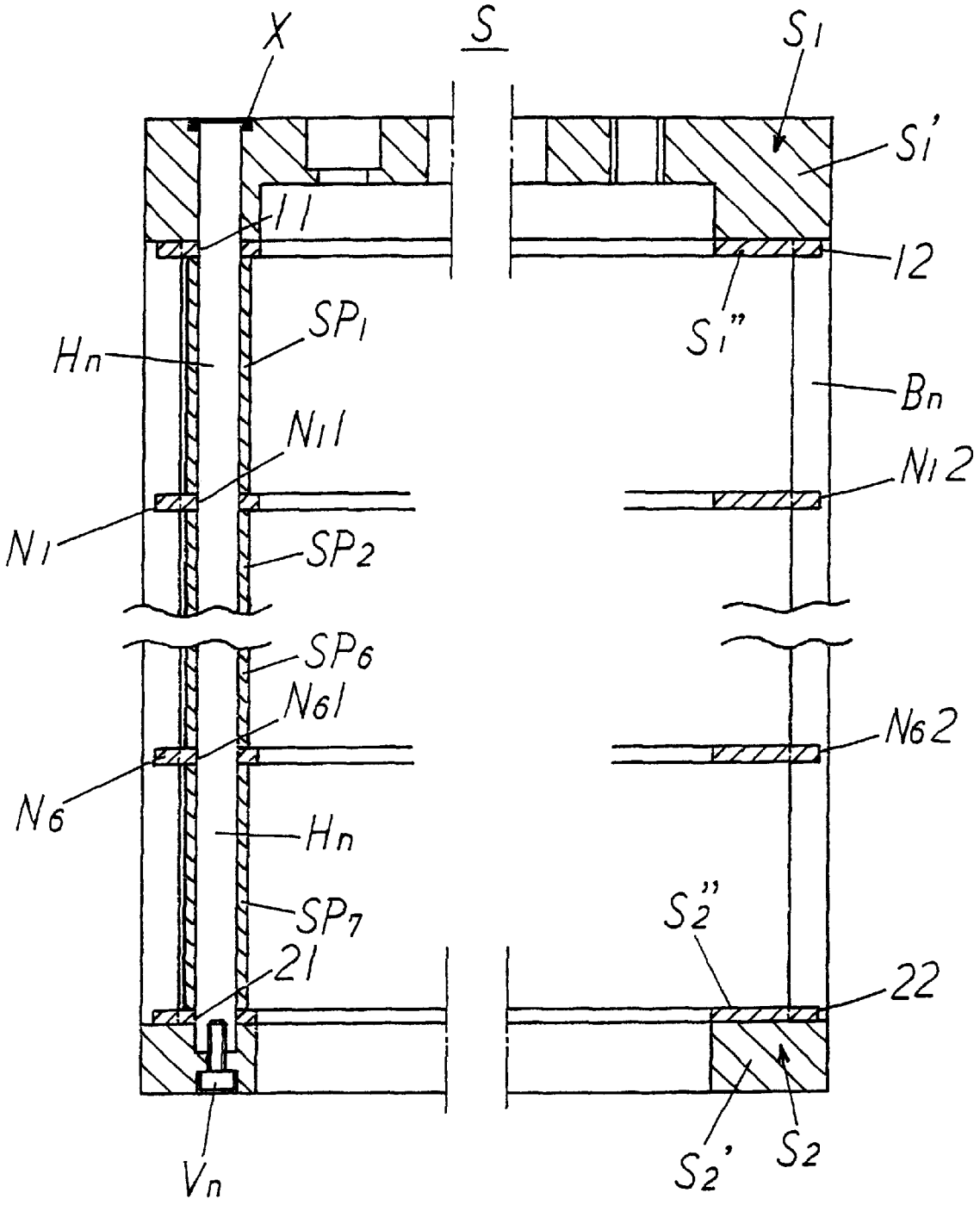
FIG. 3 is a partially cutaway enlarged schematic sectional view illustrating a part of the screen shown in FIG. 2.
Figure 6:
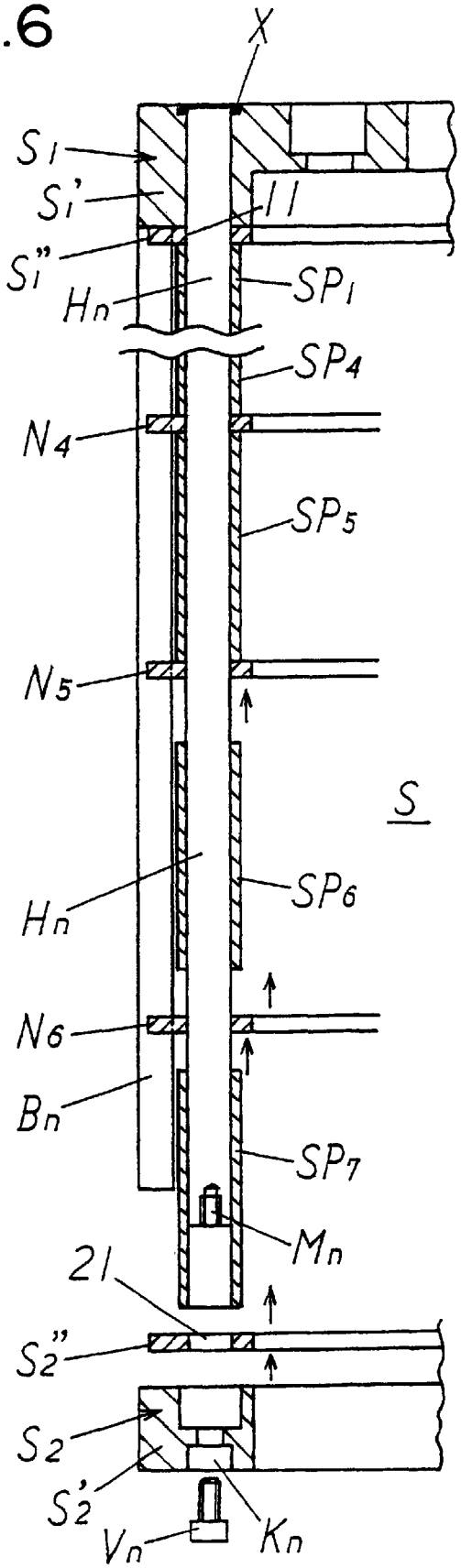
FIG. 6 is a schematic sectional view for illustrating the relationship among a screen interval keeping member, the second end plate contact member and a second end plate shown in FIG. 2.
Figure 7:
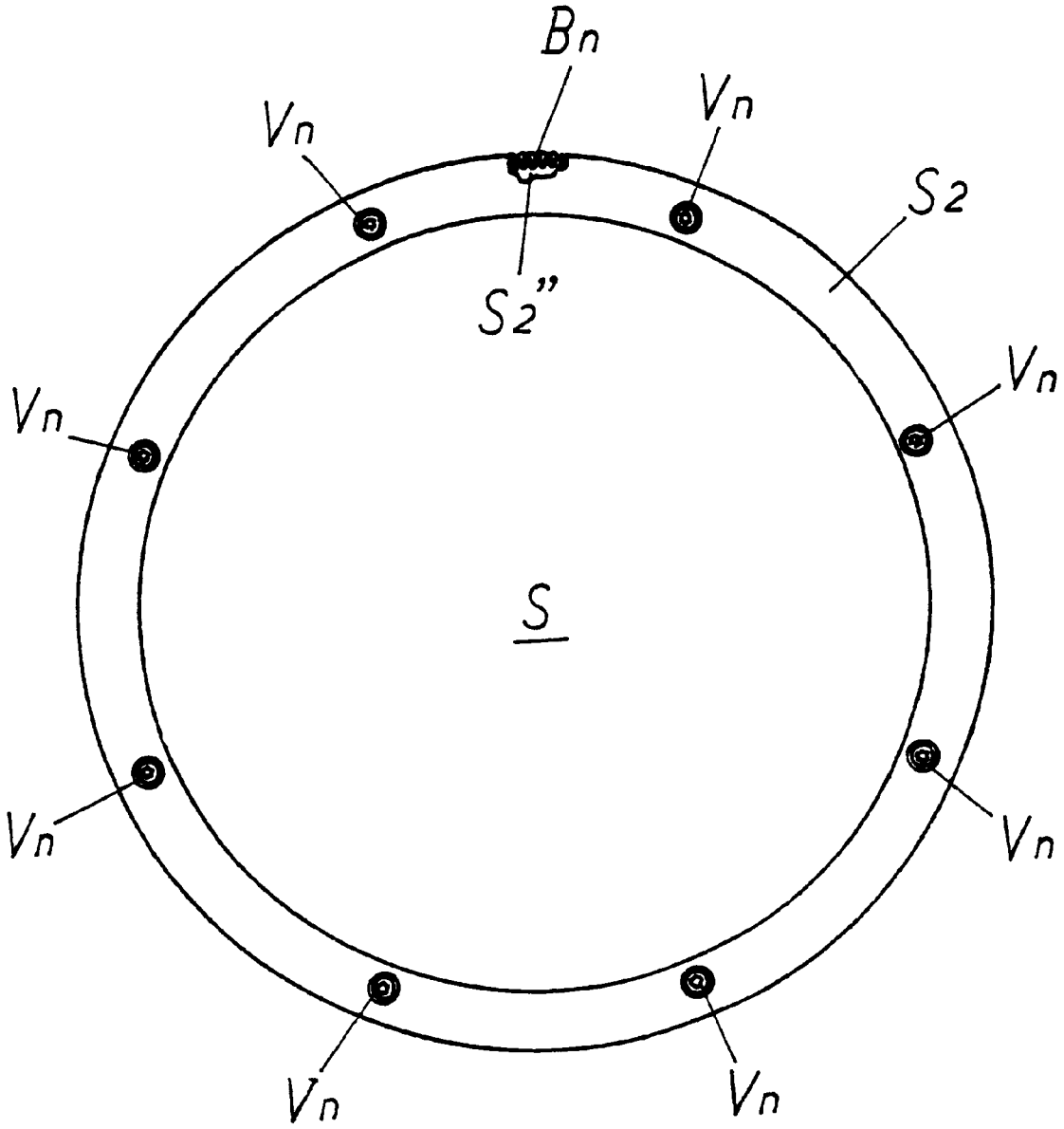
FIG. 7 is a partially cutaway schematic bottom view of FIG. 2.

The first end plate $S_1$ and the interval keeping members $H_n$ are secured by welding as shown by welded portions X in FIGS. 2, 3 and 6. The second end plate $S_2$ and the interval keeping members $H_n$ are secured in all cases by engaging male screws $V_n$ with female screws $M_n$, via openings $K_n$ for male screws provided in the second end plate $S_2$, thus tightening the second end plate $S_2$ against the plurality of interval keeping members $H_n$.

As a result, according to the screen S of the paper-making screen apparatus 1 of this embodiment, the conventional necessity to weld the first end plate and the interval keeping members is eliminated in a state in which the first end plate and the second end plate holding the ends of the plurality of rod-shaped members in between are pressed by a press or the like. It suffices to engage the male screws $V_n$ with the female screws $M_n$, via the openings $K_n$ for male screws provided in the second end plate $S_2$, thus tightening the second end plate $S_2$ against the plurality of interval keeping members $H_n$. Because at least one side of each interval keeping member $H_n$ facing the second end plate $S_2$ is secured not by welding, the secured assembly is free from the effect of welding strain, and the interval between adjacent rod-shaped members $B_n$ can be kept more uniform than in the conventional art. In addition, assembly is very easy, and further, when replacing a damaged rod-shaped member after assembly, it suffices to release screw engagement of the male screws $V_n$ and the female screws $M_n$ by loosening the male screws $V_n$, since they are not secured by welding as in the conventional case, with very easy removal.

Figure 9:
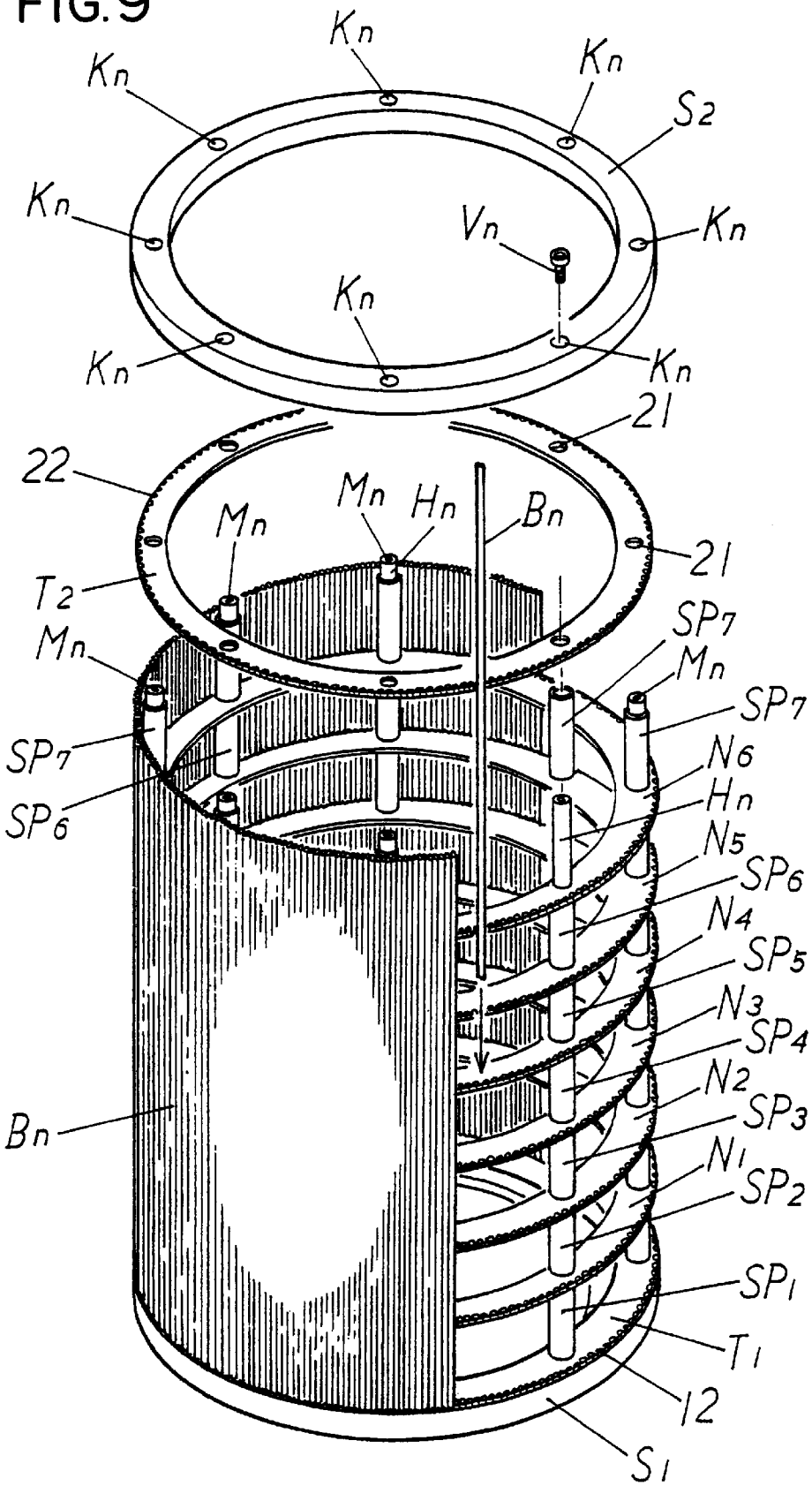
FIG. 9 is a schematic exploded perspective view for illustrating an assembly step of the screen shown in FIG. 2.

When preparing a screen S, as shown in FIG. 9, assembly is conducted with the first end plate $S_1$ at the bottom and the second end plate $S_2$ at the top, and the male screws $V_n$ are engaged with the female screws $M_n$, via the openings $K_n$ for male screws provided in the second end plate $S_2$, thereby tightening the second end plate $S_2$ against the plurality of interval keeping members $H_n$. In order to incorporate the screen S into the paper-making screen apparatus 1, as shown in FIG. 1, with the first end plate $S_1$ at the top and the second end plate $S_2$ at the bottom, the screen S is held by a screen supporting member 100 to block up the opening of the first end plate $S_1$.

The second end plate $S_2$ on the male screw $V_n$ side is located at the bottom with a view to avoiding, when detaching the screen S to differentiate it from the male screws (not shown) securing the screen S to a screen supporting member 100, operator's erroneous loosening of the male screws $V_n$ located on the second end plate $S_2$ side, which results in dismantling of the screen S.

While the first end plate $S_1$ may be formed integrally, it may also be formed into a configuration, as shown in FIG. 4, for example, in which the first end plate $S_1$ comprises a first end plate ring $S_1'$ and a ring-shaped first end plate contact member $S_1''$: the first end plate contact member $S_1''$ is located closer to the second end plate $S_2$ than the first end plate ring $S_1'$ and comes into contact with the first end plate $S_1'$, and the first end plate contact member $S_1''$ has a plurality of openings 11 for interval keeping members (see FIGS. 2 and 3) and a plurality of annularly provided engaging sections 12 for rod-shaped members.

In a state in which the first end plate $S_1$ is attached to the paper-making screen apparatus 1, the opening of the first end plate $S_1$ is blocked up by the ceiling board of the screen supporting member 100. The first end plate contact member $S_1''$ is ring-shaped, or more specifically, is of a shape of a ring largely opening including the center of the first end plate contact member $S_1'$. The engaging sections 12 for the rod-shaped members, although FIG. 2 illustrates only a part of the outer periphery of the first end plate contact member $S_1''$, are annularly provided at prescribed intervals throughout the entire outer periphery of the first end plate contact member $S_1''$ (see FIGS. 3, 4, 6 and 9).

While the second end plate $S_2$ may be formed integrally, it may also be formed into a configuration, as shown in FIG. 5 for example, in which the second end plate $S_2$ comprises a second end plate ring $S_2'$ and a ring-shaped second end plate contact member $S_2''$: the second end plate contact member $S_2''$ is located closer to the first end plate $S_1$ than the second end plate ring $S_2'$ and comes into contact with the second end plate ring $S_2'$, and the second end plate contact member $S_2''$ has a plurality of openings 21 for interval keeping members and a plurality of annularly provided engaging sections 22 for rod-shaped members. The second end plate contact member $S_2''$ is ring-shaped, or more specifically, is of a shape of a ring largely opening including the center of the second end plate contact member $S_2''$. Although FIG. 5 illustrates only a part of the outer periphery of the second end plate contact member $S_2''$, the engaging sections 22 (see FIGS. 2 and 3) for rod-shaped members are annularly provided at prescribed intervals throughout the entire outer periphery of the second end plate contact member $S_2''$ (see FIGS. 3, 5, 6 and 9).

At least two annular intermediate support members $N_n$ (while this embodiment has six intermediate support members $N_1$, $N_2$, $N_3$, $N_4$, $N_5$ and $N_6$ as shown in FIG. 2, $n(n \geqq 2)$ annular intermediate support members $N_n$ are used) are provided between the first end plate contact member $S_1''$ and the second end plate contact member $S_2''$. The annular intermediate support members $N_n$ have a plurality of openings $N_n$1 for interval keeping members and a plurality of engaging sections $N_n$2 for annularly provided rod-shaped members. The aforesaid annular intermediate support member $N_n$ is ring-shaped, or more specifically, is of the shape of a ring largely opening including the center of the intermediate support member $N_n$. Although FIG. 2 illustrates only a part of the outer periphery of the intermediate support member $N_n$, the engaging sections $N_n$2 for rod-shaped members are annularly provided at prescribed intervals throughout the entire outer periphery of the engaging sections $N_n$2 for rod-shaped members.

In this embodiment, as shown in FIG. 2, the six intermediate support members $N_1$, $N_2$, $N_3$, $N_4$, $N_5$ and $N_6$ are sequentially arranged from the first end plate contact member $S_1''$ toward the second end plate contact member $S_2''$. The intermediate support member $N_1$ has a plurality of openings $N_1$1 for interval keeping members and a plurality of annularly provided engaging sections $N_1$2 for rod-shaped members. The intermediate support member $N_2$ has a plurality of openings $N_2$1 for interval keeping members and a plurality of annularly provided engaging sections $N_2$2 for rod-shaped members. The intermediate support member $N_3$ has a plurality of openings $N_3$1 for interval keeping members and a plurality of annularly provided engaging sections $N_3$2 for rod-shaped members. The intermediate support member $N_4$ has a plurality of openings $N_4$1 for interval keeping members and a plurality of annularly provided engaging sections $N_4$2 for rod-shaped members. The intermediate support member $N_5$ has a plurality of openings $N_5$1 for interval keeping members and a plurality of annularly provided engaging sections $N_5$2 for rod-shaped members. The intermediate support member $N_6$ has a plurality of openings $N_6$1 for interval keeping members and a plurality of annularly provided engaging sections $N_6$2 for rod-shaped members.

The plurality of interval keeping members $H_n$ (in this embodiment, there are eight interval keeping members $H_n$) is provided via the openings 11 for interval keeping members of the first end plate contact member $S_1''$, openings for interval keeping members $N_1$1, $N_2$1, $N_3$1, $N_4$1, $N_5$1 and $N_6$1 of the intermediate support members $N_1$, $N_2$, $N_3$, $N_4$, $N_5$ and $N_6$, and the openings 21 for interval keeping members of the second end plate contact member $S_2''$. The interval keeping members $H_n$ and the first end plate $S_1$ are secured, for example, by welding (the welded portions is shown by X in FIG. 6), and the interval keeping members $H_n$ and the second end plate $S_2$ are secured, as described above, by engaging and tightening the male screws $V_n$ with the female screws $M_n$ via the openings $K_n$ for male screws provided in the second end plate $S_2$ on the second end plate $S_2$ side, thus keeping the interval between the first end plate $S_1$ and the second end plate $S_2$.

The male screws $V_n$ are tightened with the female screws $M_n$ so as to prevent the rod-shaped members $B_n$ from producing a play. A play of the rod-shaped member $B_n$ leads to a decrease in performance of the screen resulting from a non-uniform interval from the adjacent rod-shaped member $B_n$, or from producing a play of the rod-shaped member $B_n$ during rotation of the screen $S_1$ resulting in dismantling and breakage of the screen S. Care should be taken not to cause buckling of the rod-shaped members $B_n$ as a result of very strong tightening of the male screws $V_n$. To prevent loosening of the male screws $V_n$ after tightening, for example, tops of the male screws $V_n$ and the second end plate $S_2$ may be spot-welded to secure the male screws $V_n$, or an adhesive may be coated onto the tightening portions of the male screws $V_n$ and the female screws $M_n$ to secure the male screws $V_n$ to the female screws $M_n$.

Figure 10:
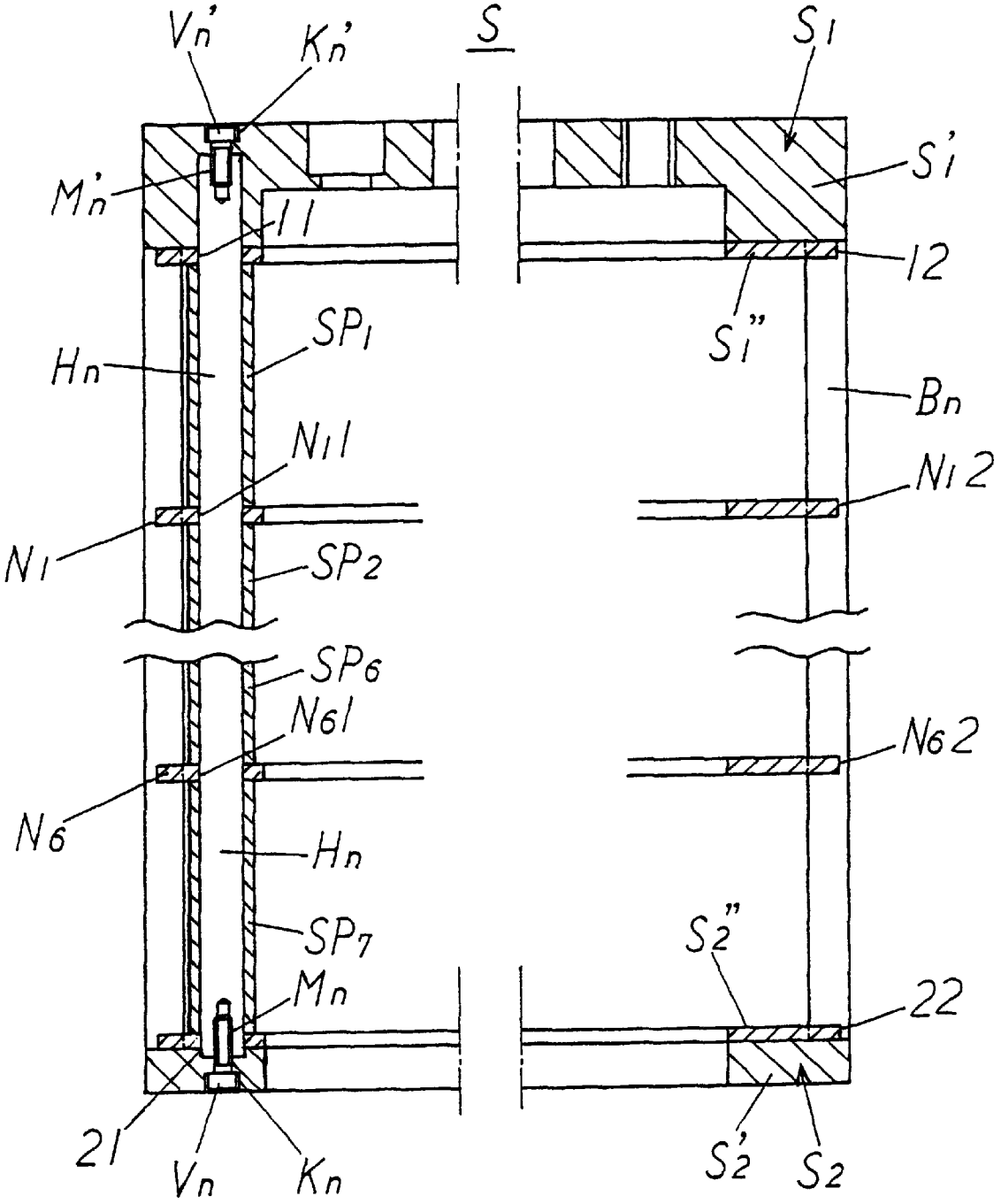
FIG. 10 is a partially enlarged schematic sectional view illustrating another embodiment of the invention different from that shown in FIG. 3.

While the interval keeping members $H_n$ and the second end plate $S_2$ are secured by welding as shown in FIG. 6, the interval keeping members $H_n$ and the first end plate $S_1$ may as required be connected by tightening the first end plate $S_1$ against the plurality of interval keeping members $H_n$ through engagement of the male screws $V_n'$ with the female screws $M_n'$ provided in the interval keeping members $H_n$ on the side facing the first end plate $S_1$ via the openings $K_n'$ provided in the first end plate $S_1$, as shown in FIG. 10, in all cases.

With a view to reinforcing the rod-shaped members $B_n$, at least two annular intermediate support members $N_n$ should be provided between the first end plate contact member $S_1''$ and the second end plate contact member $S_2''$. In this case, it is necessary to provide at least one span holding member group $SP_{n+1}$(in this embodiment having eight interval keeping members $H_n$, the span holding member group $SP_{n+1}$ would contain eight members. Each component of the span holding member group $SP_{n+1}$ is more specifically a cylindrical member known as a collar) located on the outer periphery of each of the plurality of interval keeping members $H_n$ (in this embodiment, there are eight interval keeping members). The span holding member group $SP_{n+1}$ is provided between the opposed intermediate support members $N_n$, in contact therewith, thereby keeping an interval between the opposed intermediate support members $N_n$.

It is necessary to provide at least one span holding member group $SP_{n+1}$ because if there are two intermediate support members $N_n$, n=2 leads to three span holding member group $SP_2$, $SP_3$. In the present embodiment with n=6, intermediate support members $N_1$, $N_2$, $N_3$, $N_4$, $N_5$ and $N_6$ are sequentially arranged, as shown in FIG. 2, from the first end plate contact member $S_2$" toward the second end plate contact member $S_2$". Seven span holding member groups are therefore arranged: a span holding member group $SP_2$ between the intermediate support member $N_1$ and the intermediate support member $N_2$, a span holding member group $SP_3$ between the intermediate support member $N_2$ and the intermediate support member $N_3$, a span holding member group $SP_4$ between the intermediate support member $N_3$ and the intermediate support member $N_4$, a span holding member group $SP_5$ between the intermediate support member $N_4$ and the intermediate support member $N_5$, and a span holding member group $SP_6$ between the intermediate support member $N_5$ and the intermediate support member $N_6$.

The first span holding member group $SP_1$ is provided between the first end plate contact member $S_1$" and the intermediate support member $N_1$ on the side closer to the first end plate contact member $S_1$". The first span holding member group $SP_1$ keeps an interval between the opposed first end plate contact member $S_1$" and intermediate support member $N_1$ on the side closer to the first end plate contact member $S_1$" by coming into contact with the opposed first end plate contact member $S_1$" and intermediate support member $N_1$ on the side closer to the first end plate contact member $S_1$". The first span holding member group $SP_1$ is located on the outer periphery of each of the interval keeping members $H_n$ (the present embodiment has eight interval keeping members $H_n$). A member composing the first span holding member group $SP_1$ is more specifically a cylinder used for keeping a certain distance between two members, and is a member known as a collar.

The second span holding member group $SP_7$ is provided between the second end plate contact member $S_2$" and the intermediate support member $N_6$ on the side closer to the first end plate contact member $S_1$". The second span holding member group $SP_7$ keeps an interval between the opposed second end plate contact member $S_2$" and intermediate support member $N_6$ on the side closer to the first end plate contact member $S_1$". The second span holding member group $SP_7$ is located on the outer periphery of each of the interval keeping members $H_n$ (the present embodiment has eight interval keeping members $H_n$). A member composing the second span holding member group $SP_7$ is more specifically a cylinder used for keeping a certain distance between two members, and is a member known as a collar.

One side end of each of the plurality of rod-shaped members $B_n$ (there are provided, for example, 500 rod-shaped members) having substantially a uniform cross-section (the term "cross-section" as used here means a surface obtained by cutting in a direction traversing the longitudinal direction of the rod-shaped member $B_n$) contacts the first end plate $S_1$ as shown in FIG. 4 (more specifically, a plurality of engaging sections 12 for rod-shaped members provided on the first end plate contact member $S_1$"), and the other side end, to the second end plate $S_2$ (more specifically, a plurality of engaging sections 22 for rod-shaped members provided on the second end plate contact member $S_2$41 ). The middle portions of the rod-shaped members $B_n$ are engaged, respectively, with a plurality of engaging sections $N_1$2 for rod-shaped members provided on the intermediate support member $N_1$, a plurality of engaging sections $N_2$2 for rod-shaped members provided on the intermediate support member $N_2$, a plurality of engaging sections $N_3$2 for rod-shaped members provided on the intermediate support member $N_3$, a plurality of engaging sections $N_4$2 for rod-shaped members provided on the intermediate support member $N_4$, a plurality of engaging sections $N_5$2 for rod-shaped members provided on the intermediate support member $N_5$, and a plurality of engaging sections $N_6$2 for rod-shaped members provided on the intermediate support member $N_6$. The rod-shaped members $B_n$ and the interval keeping members $H_n$ are arranged in parallel with each other.

The plurality of openings 11 for interval keeping members and the plurality of engaging sections 12 for rod-shaped members provided in the first end plate contact member $S_1$", the plurality of openings for interval keeping members $N_1$1, $N_2$1, $N_3$1, $N_4$1, $N_5$1 and $N_6$1 and the plurality of engaging sections for rod-shaped members $N_1$2, $N_2$2, $N_3$2, $N_4$2, $N_5$2 and $N_6$2 provided in the intermediate support members $N_1$, $N_2$, $N_3$, $N_4$, $N_5$ and $N_6$, and the plurality of openings 21 for interval keeping members and the plurality of engaging sections 22 for rod-shaped members provided in the second end plate contact member $S_2$41 are formed by cutting by means, for example, of a press, a laser beam or a wire cutter.

Figure 8:
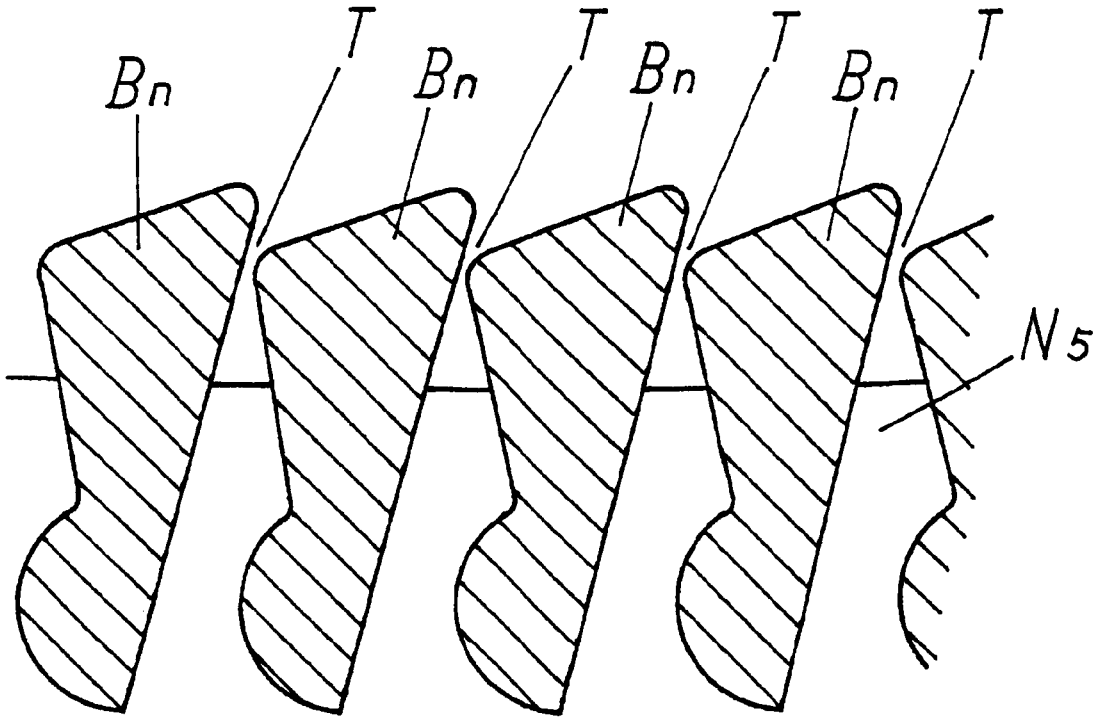
FIG. 8 is a schematic sectional view of FIG. 2 cut along the line 8—8.

The engaging sections 12 for rod-shaped members, the engaging sections for rod-shaped members $N_1$2, $N_2$2, $N_3$2, $N_4$2, $N_5$2 and $N_6$2, and the engaging sections 22 for rod-shaped members all agree with a part of the sectional shape of the rod-shaped member $B_n$. In a state in which these sections engage with the rod-shaped members $B_n$, the rod-shaped members $B_n$ are free from regulation in the longitudinal direction of the rod-shaped members $B_n$, and movement is regulated in a direction at right angles to the longitudinal direction of the rod-shaped members $B_n$. Further, in a state in which the rod-shaped members $B_n$ are arranged in parallel, an interval T is kept between two adjacent rod-shaped members $B_n$ as shown in FIG. 8.

Particularly because of the common nature between the engaging sections for rod-shaped members 12, $N_1$2, $N_2$2, $N_3$2, $N_4$2, $N_5$2, $N_6$2 and 22 engaging with the rod-shaped members $B_n$ having substantially a uniform cross-sectional shape, on the one hand, and the opening 11 for interval keeping members, the openings for interval keeping members $N_1$1, $N_2$1, $N_3$1, $N_4$1, $N_5$1 and $N_6$1, and the opening 21 for interval keeping members, at which the interval keeping members $H_n$ are located, on the other hand, use of common identical parts for the first end plate contact member $S_1$", the second end plate contact member $S_2$", and the intermediate support members $N_1$, $N_2$, $N_3$, $N_4$, $N_5$ and $N_6$ permits production of these products through the same fabrication, leading to a higher efficiency, and provides remarkable advantages in repair and other maintenance and administering efforts brought about by the possibility of using the same parts.

Figure 11:
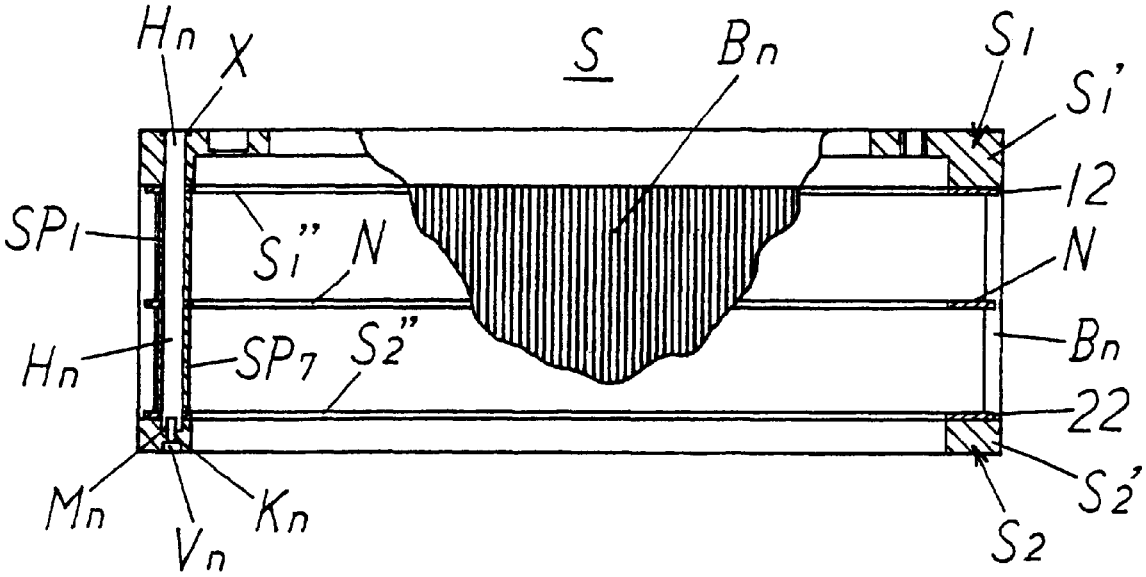
FIG. 11 is a schematic sectional view illustrating another screen different from that shown in FIG. 2.

While at least two intermediate support members $N_n$ have been required in the foregoing embodiment (FIGS. 1 to 10), only one intermediate support member $N_n$ may suffice in some cases, as shown in FIG. 11.

This case differs from the foregoing embodiment (FIGS. 1 to 10) in that the intermediate support member N is held between the first span holding member group $SP_1$ and the second span holding member group $SP_7$, resulting in the absence of opposed intermediate support members, and hence in the absence of a span holding member group for keeping an interval between opposed intermediate support members by coming into contact therewith.

In the screen S shown in FIG. 11, one side end of each of the plurality of rod-shaped members $B_n$ is in contact with the first end plate $S_1$, and the other side end, with the second end plate $S_2$, respectively. These rod-shaped members $B_n$ are annularly arranged at intervals. Two adjacent rod-shaped members $B_n$ form an interval of the screen S, and ends of the plurality of rod-shaped members $B_n$ are held between the first end plate $S_1$ and the second end plate $S_2$.

The interval keeping members $H_n$ pass through the openings $N_1$1 for interval keeping members of the intermediate support member N, and secured to the first end plate $S_1$ and the second end plate $S_2$. The first span holding member group $SP_1$ is located on the outer periphery of each of the plurality of interval keeping members $H_n$, provided between the first end plate $S_1$ and the intermediate support member N, comes into contact with the opposed first end plate $S_1$ and intermediate support member N, and thus keeps an interval between the opposed first end plate $S_1$ and intermediate support member N.

The second span holding member group $SP_7$ is located on the outer periphery of each of the plurality of interval keeping members $H_n$, is provided between the second end plate $S_2$ and the intermediate support member N, is in contact with the opposed second end plate $S_2$ and intermediate support member N to keep an interval between the opposed second end plate $S_2$ and intermediate support member N.

The second end plate $S_2$ and the interval keeping members $H_n$ are secured to each other by tightening the second end plate $S_2$ against the plurality of interval keeping members $H_n$ through engagement of the male screws $V_n$ with the female screws $M_n$ via the openings for male screws provided in the second end plate $S_2$ in all cases. The other ends of the interval keeping members $H_n$ are secured by welding to the first end plate $S_1$ (welded portions are represented by X).

In the aforesaid embodiment (FIG. 11), there has been only one intermediate support member $N_n$. In some cases, however, no intermediate support member $N_n$ is required, as shown in FIG. 12.

The case without an intermediate support member $N_n$ differs from the foregoing embodiment (FIGS. 1 to 11) in that, because of the absence of an intermediate support member, the span holding member group $SP_1$ for keeping an interval between the first end plate $S_1$ and the second end plate $S_2$ is in contact with the opposed first end plate $S_1$ and second end plate $S_2$.

Ends of the plurality of interval keeping members $H_n$ are secured to the first end plate $S_1$ and the second end plate $S_2$, respectively. In order to keep an interval between the first end plate $S_1$ and the second end plate $S_2$, therefore, it is not always necessary to provide a span holding member group $SP_1$.

Figure 12:
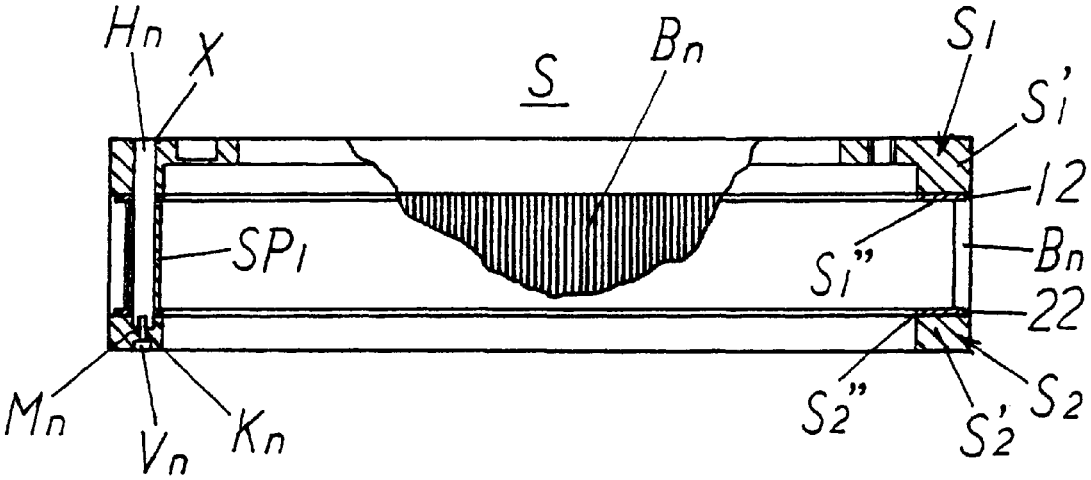
FIG. 12 is a schematic sectional view illustrating a further screen different from that shown in FIG. 11.

In the screen shown in FIG. 12, one side end of each of the plurality of rod-shaped members $B_n$ are in contact with the first end plate $S_1$, and the other side end, to the second end plate $S_2$, and the rod-shaped members $B_n$ are annularly arranged at intervals. Adjacent rod-shaped members $B_n$ form meshes of the screen S, and the ends of the plurality of rod-shaped members are held between the first end plate $S_1$ and the second end plate $S_2$. The second end plate $S_2$ and the interval keeping members $H_n$ are secured to each other by tightening the second end plate $S_2$ against the plurality of interval keeping members $H_n$ through engagement of the male screws $V_n$ with the female screws $M_n$ via the openings $K_n$ for male screws provided in the second end plate $S_2$ in all cases, as in the foregoing embodiment.

Figure 13:
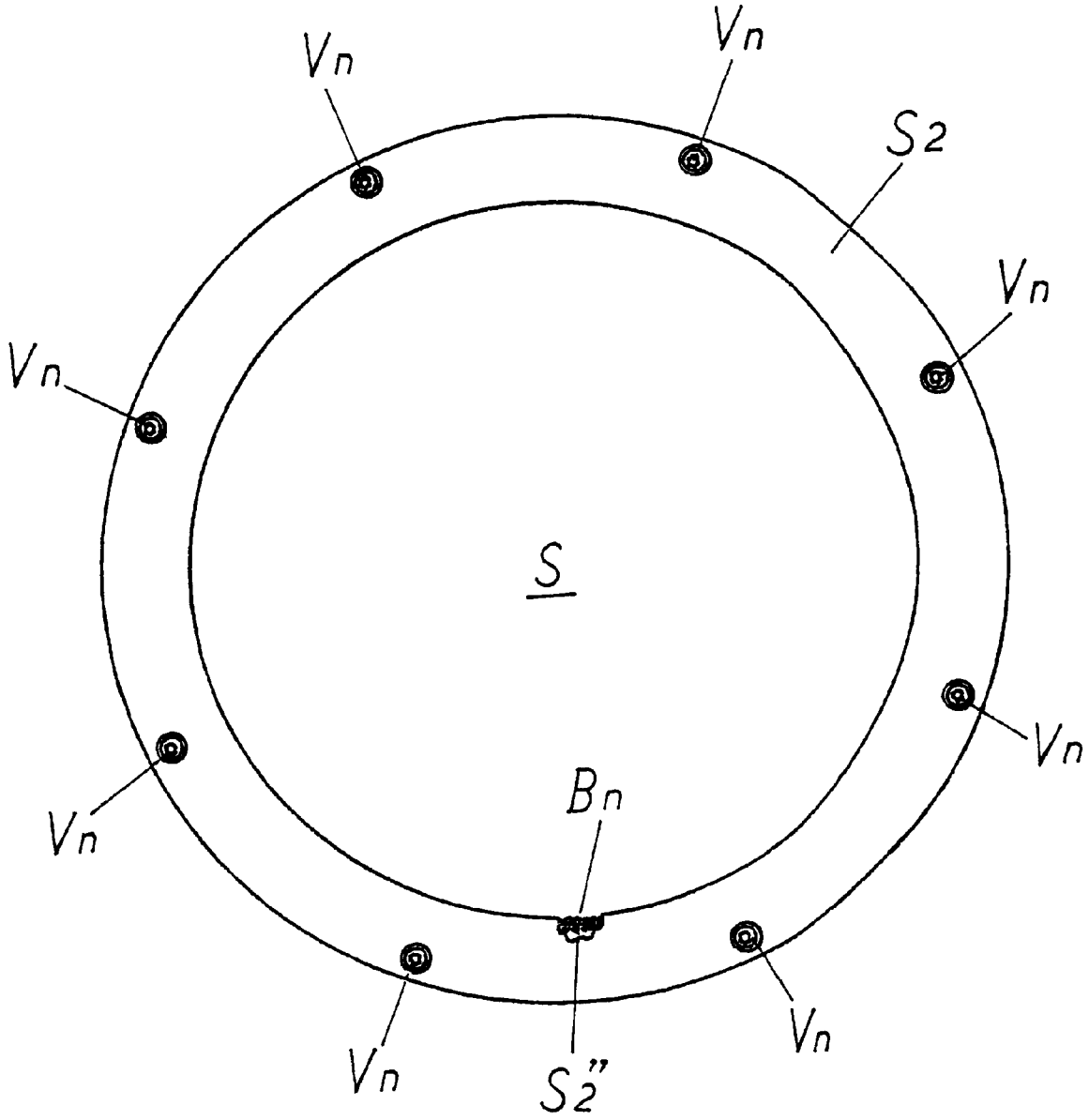
FIG. 13 is a schematic sectional view illustrating a screen when an engaging section for rod-shaped members is provided inside an opening for interval keeping member.

In the foregoing embodiment, as shown in FIG. 2, engaging sections $N_n$2 for rod-shaped members are provided on the outer periphery of the screen S, and the paper-making raw materials are caused to flow from outside to inside the screen for concentration by bringing the rod-shaped members closer to the stirring member 4. The screen is therefore of the outside pressure type (centripetal screen). In the invention, however, the screen is not limited to the above, but as shown in FIG. 13, for example, the engaging section $N_4$2 for rod-shaped members may be provided inside the opening for interval keeping member $N_4$1 (on the inner periphery of the screen S) and the rod-shaped member $B_n$ may be brought closer to the stirring member (not shown), thus adopting a screen known as an inside pressure type one (centrifugal screen) in which the paper-making raw materials are caused to flow from inside to outside the screen S.

In the foregoing embodiment (FIGS. 1 to 10), the rod-shaped members $B_n$ are engaged with the plurality of engaging sections 12 provided on the first end plate contact member $S_1$" the plurality of engaging sections for rod-shaped members $N_1$2, $N_2$2, $N_3$2, $N_4$2, $N_5$2 and $N_6$2 provided on the intermediate support members $N_1$, $N_2$, $N_3$, $N_4$, $N_5$ and $N_6$, and the plurality of engaging sections 22 for rod-shaped members provided on the second end plate contact member $S_2$". When more intermediate support members $N_n$ are provided, therefore, it becomes difficult to position the plurality of engaging sections for rod-shaped members 12, $N_1$2, $N_2$2, $N_3$2, $N_4$2, $N_5$2, $N_6$2 and 22. When conducting engagement, furthermore, the rod-shaped members $B_n$ may be damaged, or when the rod-shaped members $B_n$ are long in size, or are formed by drawing, the cross-sectional shape cannot be formed uniformly, or the interval between two adjacent rod-shaped members cannot be kept uniform.

To solve these inconveniences, the rod-shaped members $B_n$ are divided into first rod-shaped members $B_n$' and second rod-shaped members $B_n$", and an intermediate support member for connection N' is provided between the first end plate $S_1$ and the second end plate $S_2$.

Figure 14:
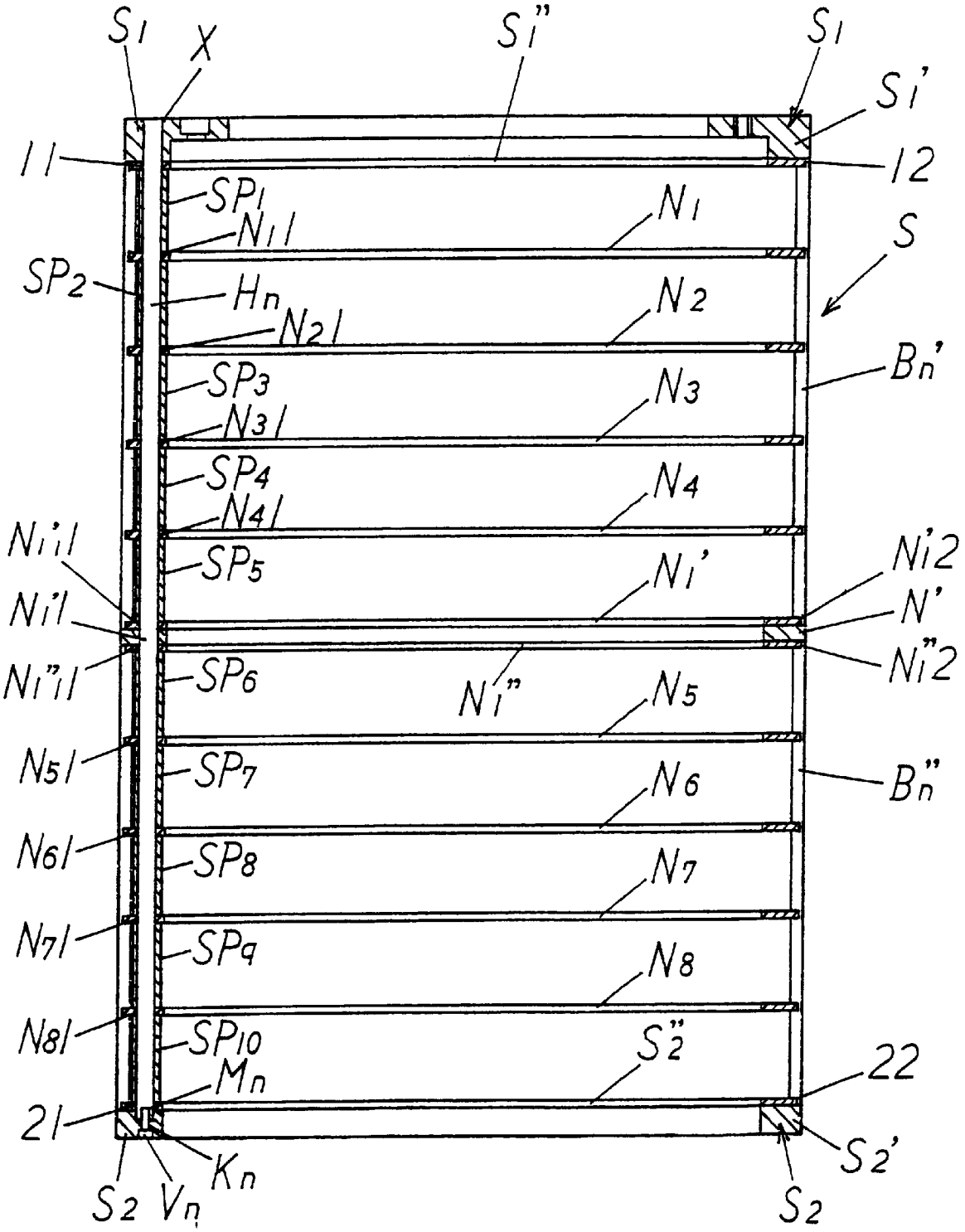
FIG. 14 is a schematic sectional view illustrating further screen different from that shown in FIG. 12.
Figure 15:
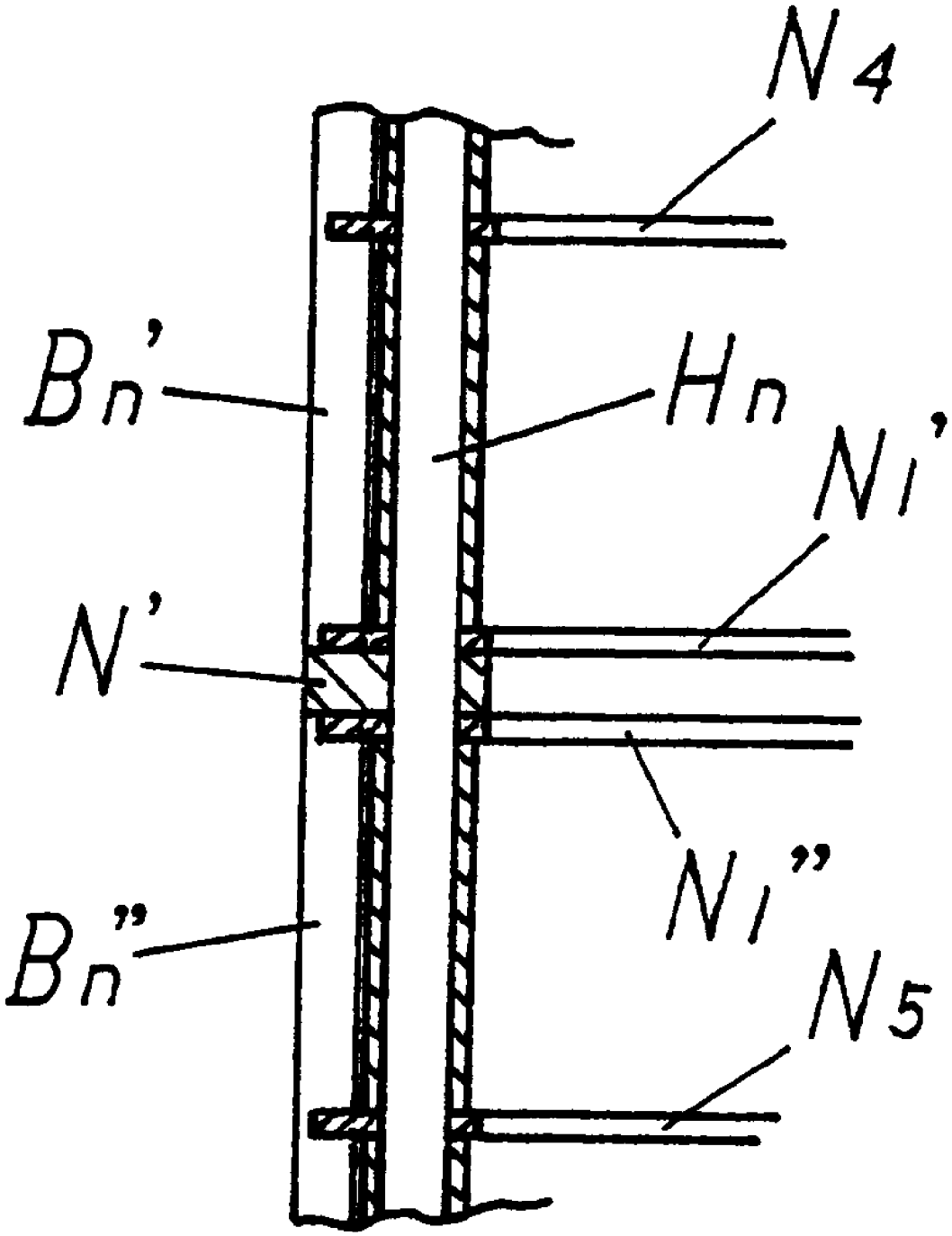
FIG. 15 is a partially enlarged schematic sectional view illustrating a part of FIG. 14.

In FIGS. 14 and 15, more particularly, the screen S is used when separating foreign matters from paper-making raw materials, as the paper-making screen apparatus shown in FIG. 1. The screen S has an intermediate support member for connection having an opening $N'_1$1 for interval keeping members between a first annular end plate $S_1$ located at an end of the screen S and a second annular end plate $S_2$ located at the other end. A plurality of interval keeping members $H_n$ (in this embodiment, there are provided eight interval keeping members $H_n$) passes through the opening $N'_1$1 for interval keeping members, and is secured to the first end plate $S_1$ and the second end plate $S_2$ to keep an interval between the first end plate $S_1$ and the second end plate $S_2$. A plurality of first rod-shaped members $B_n$' having substantially a uniform cross-sectional shape is annularly arranged at intervals between the first end plate $S_1$ and the intermediate support member N' for connection. A plurality of second rod-shaped members $B_n$" having substantially a uniform cross-sectional shape is annularly arranged at intervals between the second end plate $S_2$ and the intermediate support member N' for connection.

As a result, a mesh is formed by adjacent first rod-shaped members $B_n$' and adjacent second rod-shaped members $B_n$".

The ends of the plurality of rod-shaped members $B_n'$ are held between the first end plate $S_1$ and the intermediate support member N' for connection. The ends of the second rod-shaped members $B_n'$ are held between the second end plate $S_2$ and the intermediate support member N' for connection.

On the side of the interval keeping member $H_n$ facing the second end plate $S_2$, as in the foregoing embodiment, the second end plate $S_2$ and the interval keeping members $H_n$ are secured to each other by tightening the second end plate $S_2$ against the plurality of interval keeping members $H_n$ through engagement of the male screws $V_n$ with the female screws $M_n$ via the openings $K_n$ for male screws provided in the second end plate $S_2$ in all cases. The interval keeping members $H_n$ and the first end plate are secured to each other by welding (welded portions are represented by X in FIG. 14).

The ends of the plurality of first rod-shaped members $B_n'$ are held between the first end plate $S_1$ and the intermediate support member N' for connection. The ends of the plurality of second rod-shaped members $B_n''$ are held between the second end plate $S_2$ and the intermediate support member N' for connection. A mesh of the screen S is formed by adjacent first rod-shaped members $B_n'$ and adjacent second rod-shaped members $B_n''$.

As in the foregoing embodiment, the first end plate $S_1$ may be formed integrally. The first end plate $S_1$ may also comprise a first ring-shaped end plate ring $S_1'$ and first ring-shaped end plate contact member $S_1''$ A plurality of ring-shaped engaging sections 12 engaging with the first rod-shaped members $B_n'$ having substantially a uniform cross-sectional shape is formed by cutting by means of a press, a laser beam or a wire cutter on the first end plate contact member $S_1''$ in contact with the first end plate ring $S_1''$. Similarly, on the first intermediate contact member $N_1'$ for connection in contact with the intermediate support member N' for connection, a plurality of ring-shaped engaging sections $N_1'$2 engaging with the first rod-shaped members $B_n'$ having substantially a uniform cross-sectional shape is formed by cutting by means of a press, a laser beam or a wire cutter.

As in the foregoing embodiment, the second end plate $S_2$ may be formed integrally. The second end plate $S_2$ may also comprise a second ring-shaped end plate ring $S_2'$ and second ring-shaped end plate contact member $S_2''$. A plurality of ring-shaped engaging sections 22 engaging with the second rod-shaped members $B_n''$ having substantially a uniform cross-sectional shape is formed by cutting by means of a press, a laser or a wire cutter on the second end plate contact member $S_2$41 in contact with the second end plate ring $S_2'$. Similarly, on the second intermediate contact member $N_1''$ for connection in contact with the intermediate support member N' for connection, a plurality of ring-shaped engaging sections $N_1''$2 engaging with the second rod-shaped members $B_n''$ having substantially a uniform cross-sectional shape is formed by cutting by means of a press, a laser beam, or a wire cutter.

More specifically, an end of the first rod-shaped member $B_n'$ is in contact with the engaging section 12 formed by the first end plate ring $S_1'$ and the first end plate contact member $S_1''$, and other end of the first rod-shaped member $B_n'$ is in contact with, and is supported by, the engaging section $N_1'$2 formed by the intermediate support member $N_1$ for connection and the first intermediate contact member $N_1'$ for connection. An end of the second rod-shaped member $B_n''$ is in contact with the engaging section 22 formed by the second end plate ring $S_2'$ and the second end plate contact member $S_2''$, and the other end of the second rod-shaped member $B_n'$ is in contact with, and is supported by, the engaging section $N_1''$2 formed by the intermediate support member N' for connection and the second intermediate contact member $N_1''$.

While, in FIG. 14, eight intermediate support members $N_1$, $N_2$, $N_3$, $N_4$, $N_5$, $N_6$, $N_7$ and $N_8$ are provided between the first end plate $S_1$ and the second end plate $S_2$, the intermediate support member $N_n$ is not always necessary. When intermediate support members $N_n$ are provided, the interval between the opposed first end plate $S_1$ and intermediate support member $N_1$ closest to the first end plate $S_1$ is kept, for example, by positioning a first span holding member group $SP_1$, comprising a cylindrical collar used for keeping a distance between two members, on the outer periphery of each of the interval keeping members $H_n$, providing the same between the first end plate $S_1$ and the intermediate support member $N_1$ closest to the first end plate $S_1$, and bringing the same into contact with the opposed first end plate $S_1$ and intermediate support member $N_1$ closest to the first end plate $S_1$.

Similarly, the interval between the opposed second end plate $S_2$ and intermediate support member $N_8$ closest to the second end plate $S_2$ is kept, for example, by positioning a second span holding member group $SP_{10}$, comprising a cylindrical collar used for keeping a distance between two members, on the outer periphery of each of the interval keeping members $H_n$, providing the same between the second end plate $S_2$ and the intermediate support member $N_8$ closest to the second end plate $S_2$, and bringing the same into contact with the opposed second end plate $S_2$ and intermediate support member $N_8$ closest to the second end plate $S_2$.

Also similarly, the interval between the opposed members ($N_1$ and $N_2$), ($N_2$ and $N_3$), ($N_3$ and $N_4$), ($N_4$ and $N_1'$), ($N_1''$ and $N_5$), ($N_5$ and $N_6$), ($N_6$ and $N_7$) and ($N_7$ and $N_8$) is kept, for example, by positioning span holding member groups $SP_2$ to $SP_9$, each comprising a cylindrical collar used for keeping a distance between two members, on the outer periphery of each of the opposed members ($N_1$ and $N_2$), ($N_2$ and $N_3$), ($N_3$ and $N_4$), ($N_4$ and $N_1'$), ($N_1''$ and $N_5$), ($N_5$ and $N_6$), ($N_6$ and $N_7$) and ($N_7$ and $N_8$), and bringing the same into contact with the opposed members ($N_1$ and $N_2$), ($N_2$ and $N_3$), ($N_3$ and $N_4$), ($N_4$ and $N_1'$), ($N''_1$ and $N_5$), ($N_5$ and $N_6$), ($N_6$ and $N_7$) and ($N_7$ and $N_8$).

In order to cause the interval keeping members $H_n$ to pass through, an opening 11 for interval keeping member is provided in the first end plate $S_1$; openings for interval keeping members $N_1$1, $N_2$1, $N_3$1, $N_4$1, $N_5$1, $N_6$1, $N_7$1 and $N_8$1 are provided in the intermediate support members $N_n$; an opening for interval keeping member $N_1'_1$1 is provided in the first intermediate contact member $N_1'$ for connection; an opening for interval keeping member $N'_1$1 is provided in the intermediate support member N' for connection; an opening for interval keeping member and $N_1''_1$1 is provided in the second intermediate contact member and $N_1''$ for connection; and an opening 21 for interval keeping member is provided in the second end plate $S_2$.

According to the paper-making screen apparatus of a first aspect of the invention, the second end plate and all the interval keeping members on one side of the screen are secured by tightening the second end plate against the plurality of interval keeping members through engagement of the male screws with the female screws via the openings for male screws provided in the second end plate, fixture of at least the side of the interval keeping members facing the second end plate being thus secured without relying upon welding. As a result, the second members are free from the effect of welding strain, and it is possible to keep uniform intervals between adjacent rod-shaped members as compared with conventional ones. Furthermore, in a state in which the first end plate and the second end plate holding the plurality of rod-shaped members in between are pressed by a press or the like, it is not necessary to weld the second end plate with the interval keeping members. Assembly is very easy, and when replacing a damaged rod-shaped member after assembly, detaching is very easy since the members are not welded as in the conventional art.

According to the paper-making screen apparatus of a second aspect or a third aspect of the invention, it is possible to support the rod-shaped members by the intermediate support member and to reinforce the rod-shaped members even with long rod-shaped members, in addition to the advantages of the invention as derived from the first aspect, respectively described above.

According to the paper-making screen apparatus of a fourth aspect of the invention, when long rod-shaped members are formed by drawing, and it is consequently impossible to achieve a uniform cross-sectional shape or to keep uniform intervals between adjacent rod-shaped members, or when the rod-shaped members are too long to keep a strength, it is possible to cope with it by dividing the rod-shaped members into first rod-shaped members and second rod-shaped members and providing an intermediate support member between the first end plate and the second end plate, in addition to the advantages of the invention as derived from the first aspect, respectively described above.

According to the paper-making screen apparatus of a fifth aspect of the invention, the first end plate is composed of the first end plate ring and the first end plate contact member, and the second end plate is composed of the second end plate ring and the second end plate contact member. Even with the engaging section for rod-shaped members having a complicated shape, therefore, it is possible to easily form the engaging sections of the first end plate contact member and the second end plate contact member by cutting by means of a press, a laser beam or a wire cutter, in addition to the advantages of the invention as derived from the first to third aspects described above.

According to the paper-making screen apparatus of a sixth aspect of the invention, the first end plate is composed of the first end plate ring and the first end plate contact member, and the second end plate is composed of the second end plate ring and the second end plate contact member, and further, the first end plate contact member, the second end plate contact member, and the intermediate support member comprise identical parts. Even with the engaging sections for rod-shaped members having a complicated shape, therefore, it is possible to easily form the engaging sections for rod-shaped members of the first end plate contact member, the second end plate contact member, and the intermediate support member by cutting by means of a press, a laser beam or a wire cutter, in addition to the advantages of the invention as derived from the second and third aspects described above.

What is claimed is:

1. A paper-making screen apparatus for separating foreign matters from paper-making raw materials, comprising:

a screen having:

a first annular end plate located at an end thereof;

a second annular end plate located at the other end thereof, having a plurality of openings for male screws;

a plurality of interval keeping members each secured to said first end plate and said second end plate, keeping an interval from said first end plate and said second end plate, and having female screws on a side facing said second end plate;

a plurality of male screws engaging said female screws; and a plurality of rod-shaped members each having an end in contact with said first end plate and the other end in contact with said second end plate, and annularly arranged in parallel with each other at certain intervals;

said first end plate and said second end plate holding the ends of said plurality of rod-shaped members in between; and said second end plate being secured to said interval keeping members by engaging said male screws via the openings for the male screws provided in said second end plate with said female screws and tightening said second end plate against said plurality of interval keeping members.

2. A paper-making screen apparatus according to claim 1, wherein:

said first end plate comprises a first end plate ring and a first end plate contact member;

said first end plate contact member is located on a side closer to the second end plate than said first end plate ring, is in contact with said first end plate ring, and has a plurality of openings for interval keeping members and a plurality of engaging sections for rod-shaped members provided annularly;

said second end plate comprises a second end plate ring and a second end plate contact member;

said second end plate contact member is located on a side closer to the first end plate than said second end plate ring, is in contact with said second end plate ring, and has a plurality of openings for interval keeping members and a plurality of engaging sections for rod-shaped members provided annularly; and said plurality of openings for interval keeping members and said plurality of engaging sections for rod-shaped members provided annularly of said first end plate contact member and said second end plate contact member are formed by cutting with a press, a laser beam or a wire cutter.

3. A paper-making screen apparatus for separating foreign matters from paper-making raw materials, comprising:

a screen having:

a first annular end plate located at an end thereof;

a second annular end plate located at the other end thereof, having a plurality of openings for male screws;

an annular intermediate support member provided between said second end plate and said first end plate, and having openings for interval keeping members and engaging sections for rod-shaped members provided annularly;

a plurality of interval keeping members passing through the openings for the interval keeping members of said intermediate support member, secured to said first end plate and said second end plate, thereby keeping an interval between said first end plate and said second end plate, and each of the interval keeping members having a female screw on a side facing said second end plate;

a plurality of male screws engaging said female screws;

a first span holding member group, located on an outer periphery of each of said interval keeping members, provided between said first end plate and said intermediate support member, and each being in contact with said first end plate and said intermediate support member facing thereto, thereby keeping an interval between said first end plate and said intermediate support member facing thereto;

a second span holding member group, located on the outer periphery of each of said interval keeping members, provided between said second end plate and said intermediate support member, and each being in contact with said second end plate and said intermediate support member facing thereto, thereby keeping an interval between said second end plate and said intermediate support member facing thereto; and a plurality of rod-shaped members each having an end in contact with said first end plate and the other end in contact with said second end plate, passing through said engaging sections for rod-shaped members in the intermediate support member, and annularly arranged in parallel with each other at certain intervals;

said first end plate and said second end plate holding the ends of said plurality of rod-shaped members in between;

said rod-shaped members engaging the engaging sections free from regulation in a longitudinal direction of said rod-shaped members, and regulated for movement in a direction at right angles to the longitudinal direction of the rod-shaped members; and said second end plate being secured to said interval keeping members by engaging said male screws via the openings for the male screws provided in said second end plate with said female screws and tightening said second end plate against said plurality of interval keeping members.

4. A paper-making screen apparatus according to claim 3, wherein:

said first end plate comprises a first end plate ring and a first end plate contact member;

said first end plate contact member is located on a side closer to the second end plate than said first end plate ring, is in contact with said first end plate ring, and has a plurality of openings for interval keeping members and a plurality of engaging sections for rod-shaped members provided annularly;

said second end plate comprises a second end plate ring and a second end plate contact member;

said second end plate contact member is located on a side closer to the first end plate than said second end plate ring, is in contact with said second end plate ring, and has a plurality of openings for interval keeping members and a plurality of engaging sections for rod-shaped members provided annularly; and said plurality of openings for interval keeping members and said plurality of engaging sections for rod-shaped members provided annularly of said first end plate contact members, said second end plate contact member and said intermediate support member are formed by cutting with a press, a laser beam or a wire cutter, and said first end plate contact member, said second end plate contact member and said intermediate support member are same parts.

5. A paper-making screen apparatus for separating foreign matters from paper-making raw materials, comprising:

a screen having:

a first annular end plate located at an end thereof;

a second annular end plate located at the other end thereof, having a plurality of openings for male screws;

at least two annular intermediate support members provided between said second end plate and said first end plate, and having openings for interval keeping members and engaging sections for rod-shaped members provided annularly;

a plurality of interval keeping members passing through the openings for the interval keeping members of said intermediate support members, secured to said first end plate and said second end plate, thereby keeping an interval between said first end plate and said second end plate, and each of the interval keeping members having a female screw on a side facing said second end plate;

a plurality of male screws engaging said female screws;

at least one middle span holding member group located on an outer periphery of each of said plurality of interval keeping members, provided between two opposed intermediate support members, and keeping an interval between said opposed intermediate support members by contacting said opposed intermediate support members;

a first span holding member group located on the outer periphery of each of said interval keeping members, provided between said first end plate and one of said at least two intermediate support members closest to said first end plate, and contacting said opposed first end plate and said intermediate support member closest to said first end plate, thereby holding an interval between said opposed first end plate and said intermediate support member closest to said first end plate;

a second span holding member group located on the outer periphery of each of said interval keeping members, provided between said second end plate and the other of said at least two intermediate support members closest to said second end plate, and contacting said opposed second end plate and said intermediate support member closest to said second end plate, thereby holding an interval between said opposed second end plate and said intermediate support member closest to said second end plate; and a plurality of rod-shaped members each having an end in contact with said first end plate and the other end in contact with said second end plate, passing through said engaging sections for rod-shaped members, and annularly arranged in parallel with each other at certain intervals;

said first end plate and said second end plate holding the ends of said plurality of rod-shaped members in between;

said rod-shaped members engaging the engaging sections for rod-shaped members being free from regulation in a longitudinal direction of said rod-shaped members, and regulated for movement in a direction at right angles to the longitudinal direction of the rod-shaped members; and said second end plate being secured to said interval keeping members by engaging said male screws via the openings for the male screws provided in said second end plate with said female screws and tightening said second end plate against said plurality of interval keeping members.

6. A paper-making screen apparatus for separating foreign matters from paper-making raw materials, comprising:

a screen having:

a first annular end plate located at an end thereof;

a second annular end plate located at the other end thereof, having a plurality of openings for male screws;

an intermediated support member for connection provided between said second end plate and said first end plate, and having openings for interval keeping members;

a plurality of interval keeping members passing through said openings for interval keeping members, secured to said first end plate and said second end plate, keeping an interval between said first end plate and said second end plate, and each of the interval keeping members having a female screw on a side facing said second end plate;

a plurality of male screws engaging with said female screws;

a plurality of first rod-shaped members annularly arranged in parallel with each other at certain intervals between said first end plate and said intermediate support member for connection; and a plurality of second rod-shaped members annularly arranged in parallel with each other at certain intervals between said second end plate and said intermediate support member for connection;

ends of said plurality of said first rod-shaped members being held between said first end plate and said intermediate support member for connection, and ends of said plurality of said second rod-shaped members being held between said second end plate and said intermediate support member for connection; and said second end plate being secured to said interval keeping members by engaging said male screws via the openings for the male screws provided in said second end plate with said female screws and tightening said second end plate against said plurality of interval keeping members.

* * * * *